US009898970B2

(12) United States Patent
Kang et al.

(10) Patent No.: US 9,898,970 B2
(45) Date of Patent: Feb. 20, 2018

(54) VOLTAGE PROVIDING CIRCUIT WITH POWER SEQUENCE CONTROLLER AND DISPLAY DEVICE INCLUDING THE SAME

(71) Applicant: SAMSUNG DISPLAY CO., LTD., Yongin, Gyeonggi-Do (KR)

(72) Inventors: Byeong-Doo Kang, Cheonan-si (KR); Jong-Man Bae, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 117 days.

(21) Appl. No.: 14/624,538

(22) Filed: Feb. 17, 2015

(65) Prior Publication Data

US 2016/0078818 A1 Mar. 17, 2016

(30) Foreign Application Priority Data

Sep. 16, 2014 (KR) ..... 10-2014-0122509

(51) Int. Cl.
*G09G 5/00* (2006.01)
*G09G 3/3291* (2016.01)
*G05F 1/575* (2006.01)

(52) U.S. Cl.
CPC ..... *G09G 3/3291* (2013.01); *G05F 1/575* (2013.01); *G09G 2300/0814* (2013.01);
(Continued)

(58) Field of Classification Search
CPC ..... G09G 3/30–3/3291; G09G 3/36–3/3696; G09G 2330/02;
(Continued)

(56) References Cited

U.S. PATENT DOCUMENTS

2002/0011973 A1* 1/2002 Komiya ..... G09G 3/3233 345/75.2
2002/0036636 A1* 3/2002 Yanagi ..... G09G 3/3696 345/211
(Continued)

FOREIGN PATENT DOCUMENTS

KR 10-2009-0022676 A 3/2009
KR 10-2009-0043211 A 5/2009
(Continued)

*Primary Examiner* — Yuzhen Shen
(74) *Attorney, Agent, or Firm* — Lewis Roca Rothgerber Christie LLP

(57) ABSTRACT

A display device includes a data driver configured to generate a data signal based on a data voltage; a display panel configured to be driven based on a first power supply voltage and the data signal; a timing controller configured to control operations of the data driver and the display panel and configured to generate a ready signal indicating a power supply timing; a first voltage regulator configured to generate the first power supply voltage based on a first input voltage and a first enable signal; a second voltage regulator configured to generate the data voltage based on the first input voltage and a second enable signal; and a power sequence controller configured to generate the first enable signal based on the ready signal and the data voltage and configured to generate the second enable signal based on the ready signal and the first power supply voltage.

16 Claims, 11 Drawing Sheets

(52) U.S. Cl.
CPC ..... *G09G 2300/0819* (2013.01); *G09G 2320/0247* (2013.01); *G09G 2330/027* (2013.01); *G09G 2330/028* (2013.01)

(58) Field of Classification Search
CPC ..... G09G 2330/026–2330/028; H02M 1/00–1/44; H02M 3/00–3/44
See application file for complete search history.

(56) References Cited

U.S. PATENT DOCUMENTS

2006/0050042 A1* 3/2006 Yi ..... G09G 3/3696 345/98
2008/0158126 A1* 7/2008 Tung ..... G09G 3/3648 345/92
2008/0284497 A1* 11/2008 Kim ..... G09G 3/3696 327/536
2008/0309608 A1* 12/2008 Shen ..... G09G 3/3696 345/101
2009/0073154 A1* 3/2009 Lee ..... G09G 3/3666 345/211
2010/0328287 A1* 12/2010 Hsu ..... G09G 3/3696 345/211
2011/0001534 A1* 1/2011 Chuang ..... G09G 3/3696 327/200
2013/0249781 A1* 9/2013 Park ..... G09G 3/3688 345/99
2016/0079976 A1* 3/2016 Saeki ..... H03K 19/00315 345/211
2017/0004800 A1* 1/2017 Park ..... G09G 3/3696
2017/0006688 A1* 1/2017 Dai ..... G09G 3/2003

FOREIGN PATENT DOCUMENTS

KR 10-2011-0044563 A 4/2011
KR 10-2011-0071429 A 6/2011

* cited by examiner

VOLTAGE PROVIDING CIRCUIT WITH POWER SEQUENCE CONTROLLER AND DISPLAY DEVICE INCLUDING THE SAME

CROSS REFERENCE TO RELATED APPLICATION

This application claims priority to and the benefit of Korean Patent Application No. 10-2014-0122509 filed on Sep. 16, 2014, in the Korean Intellectual Property Office (KIPO), the disclosure of which is hereby incorporated by reference herein in its entirety.

BACKGROUND

1. Field

Example embodiments of the present invention relate to a voltage providing circuit and a display device including the voltage providing circuit.

2. Discussion of the Related Art

Recently, various display devices such as liquid crystal displays (LCDs), plasma displays, and electroluminescent displays have gained popularity. Particularly, the electroluminescent display can be driven with quick response speed and reduced power consumption, using a light-emitting diode (LED) or an organic light-emitting diode (OLED) that emits light through recombination of electrons and holes.

The electroluminescent display can be driven with an analog or a digital driving method. While the analog driving method produces grayscale using variable voltage levels corresponding to input data, the digital driving method produces grayscale using variable time duration in which the LED emits light. The analog driving method may be difficult to implement because it may utilize a driving integrated circuit (IC) that is complicated to manufacture if the display is large and has high resolution. The digital driving method, on the other hand, can readily accomplish the required high resolution through a simpler IC structure.

In the digital driving method, quality of the displayed image may be degraded due to timing deviation of proving power supply voltages, ohmic drop or IR-drop of the voltages, etc.

SUMMARY

At least one example embodiment of the present invention includes a voltage providing circuit configured to control a power sequence efficiently.

At least one example embodiment of the present invention includes a display device including a voltage providing circuit configured to control a power sequence efficiently.

According to example embodiments, a display device includes a data driver configured to generate a data signal based on a data voltage, a display panel configured to be driven based on a first power supply voltage and the data signal, a timing controller configured to control operations of the data driver and the display panel and configured to generate a ready signal indicating a power supply timing, a first voltage regulator configured to generate the first power supply voltage based on a first input voltage and a first enable signal, a second voltage regulator configured to generate the data voltage based on the first input voltage and a second enable signal and a power sequence controller configured to generate the first enable signal based on the ready signal and the data voltage and configured to generate the second enable signal based on the ready signal and the first power supply voltage.

The power sequence controller may be configured to deactivate the second enable signal after deactivating the first enable signal, and the second voltage regulator may be configured to be disabled in response to the second enable signal after the first voltage regulator is disabled in response to the first enable signal.

The power sequence controller may be configured to activate the first enable signal after activating the second enable signal, and the first voltage regulator may be configured to be enabled in response to the first enable signal after the second voltage regulator is enabled in response to the second enable signal.

The power sequence controller may be configured to activate the second enable signal when the first power supply voltage increases higher than a first voltage level or the ready signal is activated.

The power sequence controller may be configured to deactivate the second enable signal when the first power supply voltage decreases lower than a first voltage level and the ready signal is deactivated.

The power sequence controller may be configured to activate the first enable signal when the data voltage increases higher than a second voltage level and the ready signal is activated.

The power sequence controller may be configured to deactivate the first enable signal when the data voltage decreases lower than a second voltage level or the ready signal is deactivated.

The power sequence controller may include a first feedback unit configured to compare the first power supply voltage and a first voltage level to generate a first comparison signal that is activated when the first power supply voltage is higher than the first voltage level, a second feedback unit configured to compare the data voltage and a second voltage level to generate a second comparison signal that is activated when the data voltage is higher than the second voltage level, an AND logic gate configured to perform an AND logic operation on the ready signal and the second comparison signal to generate the first enable signal and an OR logic gate configured to perform an OR logic operation on the ready signal and the first comparison signal to generate the second enable signal.

The first feedback unit may include first division resistors configured to divide the first power supply voltage to provide a first division voltage and a first comparator configured to compare the first division voltage and a first reference voltage to generate the first comparison signal.

The second feedback unit may include second division resistors configured to divide the data voltage to provide a second division voltage and a second comparator configured to compare the second division voltage and a second reference voltage to generate the second comparison signal.

The display device may further include a voltage monitor configured to monitor a change of a second input voltage to generate a monitoring signal.

The display device may further include a third voltage configured to generate a second power supply voltage based on the second input voltage, and the second power supply voltage may be provided to the timing controller as a power source.

The power sequence controller may be configured to generate the first enable signal based on the ready signal, the data voltage and the monitoring signal.

The voltage monitor may be configured to activate the monitoring signal when the second input voltage increases higher than a reference voltage level.

The voltage monitor may be configured to deactivate the monitoring signal when the second input voltage maintains lower than the reference voltage level for a reference time interval.

The voltage monitor may include: a detector configured to compare the second input voltage and a reference voltage level to generate a comparison signal that is activated when the second input voltage is higher than the reference voltage level; and a counting unit configured to generate the monitoring signal based on transition timings of the comparison signal such that the counting unit is configured to activate the monitoring signal when the second input voltage increases higher than a reference voltage level and to deactivate the monitoring signal when the second input voltage is maintained lower than the reference voltage level for a reference time interval.

The power sequence controller may include a first feedback unit configured to compare the first power supply voltage and a first voltage level to generate a first comparison signal that is activated when the first power supply voltage is higher than the first voltage level, a second feedback unit configured to compare the data voltage and a second voltage level to generate a second comparison signal that is activated when the data voltage is higher than the second voltage level, an AND logic gate configured to perform an AND logic operation on the monitoring signal, the ready signal and the second comparison signal to generate the first enable signal and an OR logic gate configured to perform an OR logic operation on the ready signal and the first comparison signal to generate the second enable signal.

According to example embodiments, a voltage providing circuit includes a first voltage regulator configured to generate a power supply voltage based on an input voltage and a first enable signal, a second voltage regulator configured to generate a data voltage based on the input voltage and a second enable signal and a power sequence controller configured to generate the first enable signal based on the data voltage and a ready signal indicating a power supply timing and configured to generate the second enable signal based on the ready signal and the power supply voltage.

The power sequence controller may include a first feedback unit configured to compare the power supply voltage and a first voltage level to generate a first comparison signal that is activated when the power supply voltage is higher than the first voltage level, a second feedback unit configured to compare the data voltage and a second voltage level to generate a second comparison signal that is activated when the data voltage is higher than the second voltage level, an AND logic gate configured to perform an AND logic operation on the ready signal and the second comparison signal to generate the first enable signal and an OR logic gate configured to perform an OR logic operation on the ready signal and the first comparison signal to generate the second enable signal.

According to example embodiments, a voltage providing circuit includes a first voltage regulator configured to generate a first power supply voltage based on a first input voltage and a first enable signal, a second voltage regulator configured to generate a data voltage based on the first input voltage and a second enable signal, a third voltage regulator configured to generate a second power supply voltage based on a second input voltage lower than the first input voltage, a voltage monitor configured to monitor a change of the second input voltage to generate a monitoring signal and a power sequence controller configured to generate the first enable signal based on the monitoring signal, the data voltage and a ready signal indicating a power supply timing and configured to generate the second enable signal based on the ready signal and the power supply voltage.

The voltage providing circuit and the display device including the voltage providing circuit may be configured such that the outputs of the voltage regulators are feedback to each other, and thus may control the power sequence efficiently without adding complex hardware and/or software.

Further the voltage providing circuit and the display device including the voltage providing circuit may control the power sequence efficiently in unexpected power-off situations using the voltage monitor and thus may enhance image quality by preventing flickering of displayed images.

BRIEF DESCRIPTION OF THE DRAWINGS

Example embodiments of the present invention will be more clearly understood from the following detailed description taken in conjunction with the accompanying drawings.

DETAILED DESCRIPTION

Figure 1:
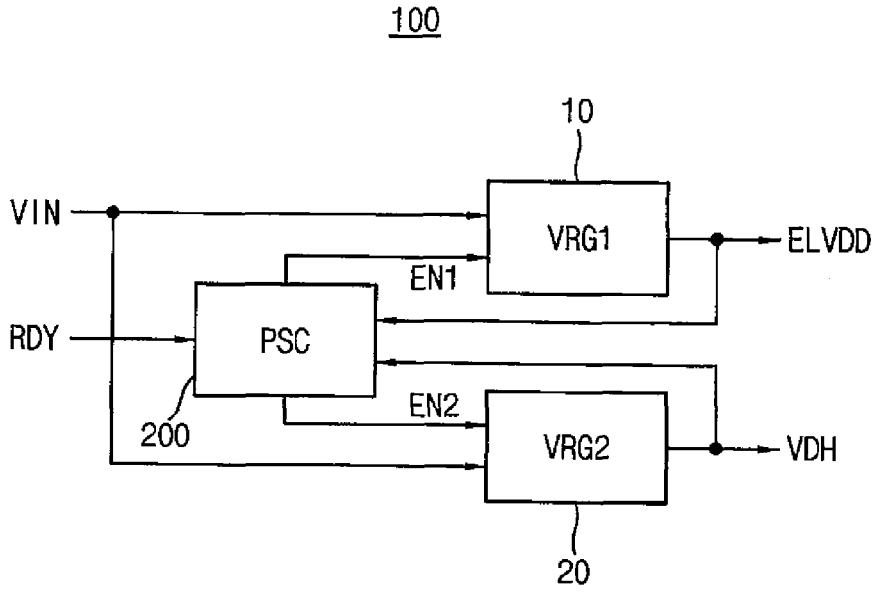
FIG. 1 is a block diagram illustrating a voltage providing circuit according to example embodiments.

The example embodiments are described more fully hereinafter with reference to the accompanying drawings. Like or similar reference numerals refer to like or similar elements throughout.

FIG. 1 is a block diagram illustrating a voltage providing circuit according to example embodiments.

Referring to FIG. 1, a voltage providing circuit 100 includes a first voltage regulator VRG1 10, a second voltage regulator VRG2 20 and a power sequence controller PSC 200.

The first voltage regulator 10 generates a power supply voltage ELVDD based on an input voltage VIN and a first enable signal EN1. The second voltage regulator 20 generates a data voltage VDH based on the input voltage VIN and a second enable signal EN2.

The input voltage VIN may be provided from an external power source such as a switching mode power supply (SMPS). For example, the power supply voltage ELVDD may be a power supply voltage of a display device including the voltage providing circuit 100, and the data voltage VDH may be a voltage for driving a data signal in the display device. The first voltage regulator 10 and the second voltage regulator 20 are designed to provide the stable voltages even though the voltage level and/or the frequency of the input voltage VIN are varied. The first voltage regulator 10 and the second voltage regulator 20 may be referred to as a voltage converter, a power management integrated circuit (PMIC), etc.

The power sequence controller 200 is configured to receive the power supply voltage ELVDD and the data voltage VDH that are fed-back from the first voltage regulator 10 and the second voltage regulator 20 to generate the first enable signal EN1 and the second enable signal EN2. As described with reference to FIG. 3, the power sequence controller 200 may generate the first enable signal EN1 based on the data voltage VDH and a ready signal RDY indicating a power supply timing and may generate the second enable signal EN2 based on the ready signal RDY and the power supply voltage ELVDD. As described with reference to FIG. 4, the ready signal RDY may be provided from a timing controller of the display device.

Figure 2:
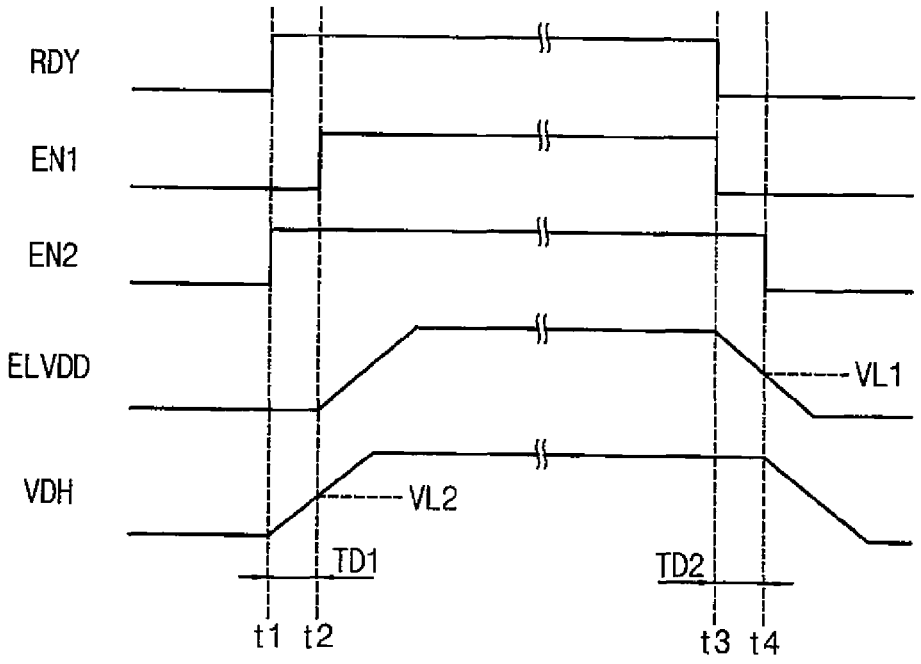
FIG. 2 is a timing diagram illustrating an operation of the voltage providing circuit of FIG. 1.

FIG. 2 is a timing diagram illustrating an operation of the voltage providing circuit of FIG. 1.

Hereinafter, it is assumed that a logic low level is a deactivation level of a signal and a logic high level is an activation level of the signal. In other circuit configurations, the logic low level may be the activation level and the logic high level may be the deactivation level.

Referring to FIGS. 1 and 2, at time point t1, the ready signal RDY is activated to the logic high level and the second enable signal EN2 is activated in response to the activated ready signal RDY. The second enable signal EN2 maintains the deactivated logic low level even though the ready signal RDY is activated. The second voltage regulator 20 is enabled and the data voltage VDH begins to increase in response to the activated second enable signal EN2.

At time point t2 after a first delay time TD1, the data voltage VDH reaches a voltage level VL2 and the first enable signal EN1 is activated to the logic high level. The first voltage regulator 10 is enabled and the power supply voltage ELVDD begins to increase in response to the activated first enable signal EN1.

As such, the power sequence controller 200 may receive the fed-back voltages ELVDD and VDH to activate the first enable signal EN1 after activating the second enable signal EN2. The power-on sequence of the power supply voltage ELVDD and the data voltage VDH may be performed in response to the activation sequence of the first enable signal EN1 and the second enable signal EN2. In other words, the first voltage regulator 10 may be enabled in response to the first enable signal EN1 after the second voltage regulator 20 is enabled in response to the second enable signal EN2.

At time point t3, the ready signal is deactivated to the logic low level and the first enable signal EN1 is deactivated to the logic low level. The second enable signal EN2 maintains the activated logic high level even though the ready signal is deactivated. The first voltage regulator 10 is disabled and the power supply voltage ELVDD begins to decrease in response to the deactivated first enable signal EN1.

At time point t4 after a second delay time TD2, the power supply voltage ELVDD reaches a voltage level VL1 and the second enable signal EN2 is deactivated to the logic low level. The second voltage regulator 20 is disabled and the data voltage VDH begins to decrease in response to the deactivated second enable signal EN2.

As such, the power sequence controller 200 may receive the fed-back voltages ELVDD and VDH to deactivate the second enable signal EN2 after deactivating the first enable signal EN1. The power-off sequence of the power supply voltage ELVDD and the data voltage VDH may be performed in response to the deactivation sequence of the first enable signal EN1 and the second enable signal EN2. In other words, the second voltage regulator 20 may be disabled in response to the second enable signal EN2 after the first voltage regulator 10 is enabled in response to the first enable signal EN1.

As such, the voltage providing circuit may be configured such that the outputs of the voltage regulators are fed back to each other, and thus may control the power sequence efficiently without adding complex hardware and/or software.

Figure 3:
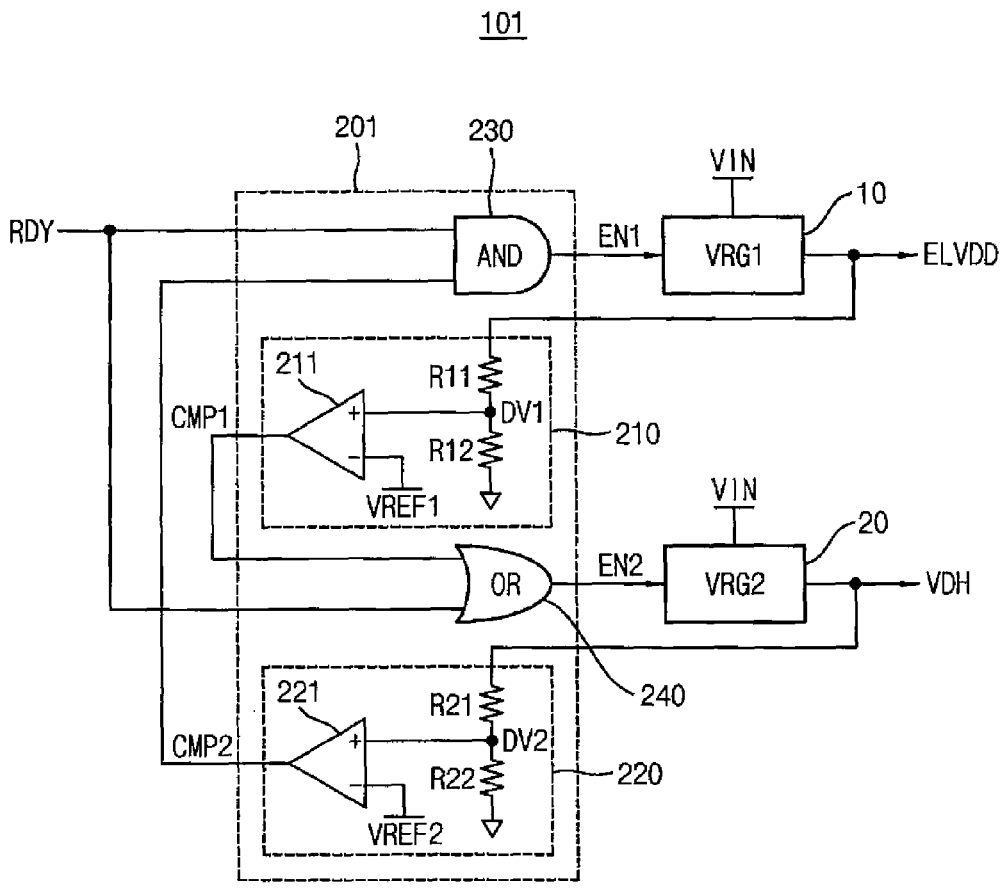
FIG. 3 is a circuit diagram illustrating a voltage providing circuit according to an example embodiment.

FIG. 3 is a circuit diagram illustrating a voltage providing circuit according to an example embodiment.

Referring to FIG. 3, a voltage providing circuit 101 includes a first voltage regulator VRG1 10, a second voltage regulator VRG2 20 and a power sequence controller 201.

The first voltage regulator VRG1 10 generates a power supply voltage ELVDD based on an input voltage VIN and a first enable signal EN1. The second voltage regulator VRG2 20 generates a data voltage VDH based on the input voltage VIN and a second enable signal EN2.

The power sequence controller 201 may include a first feedback unit 210, a second feedback unit 220, an AND logic gate 230 and an OR logic gate 240.

The first feedback unit 210 may compare the power supply voltage ELVDD and a first voltage level VL1 to generate a first comparison signal CMP1 that is activated when the power supply voltage ELVDD is higher than the first voltage level VL1. The first voltage level is further described below. The second feedback unit 220 may compare the data voltage VDH and a second voltage level VL2 to generate a second comparison signal CMP2 that is activated when the data voltage VDH is higher than the second voltage level VL2. The second voltage level VL2 is further described below. The AND logic gate 230 may perform an AND logic operation on the ready signal RDY and the second comparison signal CMP2 to generate the first enable signal EN1. The OR logic gate 240 may perform an OR logic operation on the ready signal RDY and the first comparison signal CMP1 to generate the second enable signal EN2.

The power sequence controller 201 may control the activation and deactivation timings of the first enable signal EN1 using the AND logic gate 230 and performing an AND logic operation on the ready signal RDY and the second comparison signal CMP2 that is based on the fed-back data voltage VDH. In other words, the power sequence controller 201 may activate the first enable signal EN1 when the data voltage increases higher than the second voltage level VL2 and the ready signal RDY is activated. In addition, the power sequence controller 201 may deactivate the first enable signal EN1 when the data voltage VDH decreases lower than the second voltage level VL2 or the ready signal RDY is deactivated.

The power sequence controller 201 may control the activation and deactivation timings of the second enable signal EN2 using the OR logic gate 240 and performing an OR logic operation on the ready signal RDY and the first comparison signal CMP1 that is based on the fed-back power supply voltage ELVDD. In other words, the power sequence controller 201 may activate the second enable signal EN when the power supply voltage ELVDD increases higher than the first voltage level VL1 or the ready signal RDY is activated. In addition, the power sequence controller 201 may deactivate the second enable signal EN2 when the power supply voltage ELVDD decreases lower than the first voltage level VL1 and the ready signal RDY is deactivated.

As such, the power sequence controller 201 may implement the power-on sequence at time points t1 and t2 and the power-off sequence at time points t3 and t4 as illustrated in FIG. 2 using the AND logic gate 230 and the OR logic gate 240.

As illustrated in FIG. 3, the first feedback unit 210 may include first division resistors R11 and R12 and a first comparator 211, and the second feedback unit 220 may include second division resistors R21 and R22 and a second comparator 221. The first division resistors R11 and R12 may divide the power supply voltage ELVDD to provide a first division voltage DV1, and the first comparator 211 may compare the first division voltage DV1 and a first reference voltage VREF1 to generate the first comparison signal CMP1. The second division resistors R21 and R22 may divide the data voltage VDH to provide a second division voltage DV2, and the second comparator 221 may compare the second division voltage DV2 and a second reference voltage VREF2 to generate the second comparison signal CMP2.

The first feedback unit 210 may compare the power supply voltage ELVDD and the first voltage level VL1 by comparing the first division voltage DV1 and the first reference voltage VREF1. The first voltage level VL1 may be obtained using the relation VL1=VREF1*(R11+R12)/R12. Accordingly the second delay time TD2 in FIG. 2 may be adjusted by controlling the resistance ratio of the first division resistors R11 and R12. In the same way, the second feedback unit 220 may compare the data voltage VDH and the second voltage level VL2 by comparing the second division voltage DV2 and the second reference voltage VREF2. The second voltage level VL2 may be obtained using the relation VL2=VREF2*(R21+R22)/R22. Accordingly the first delay time TD1 in FIG. 2 may be adjusted by controlling the resistance ratio of the second division resistors R21 and R22.

Figure 4:
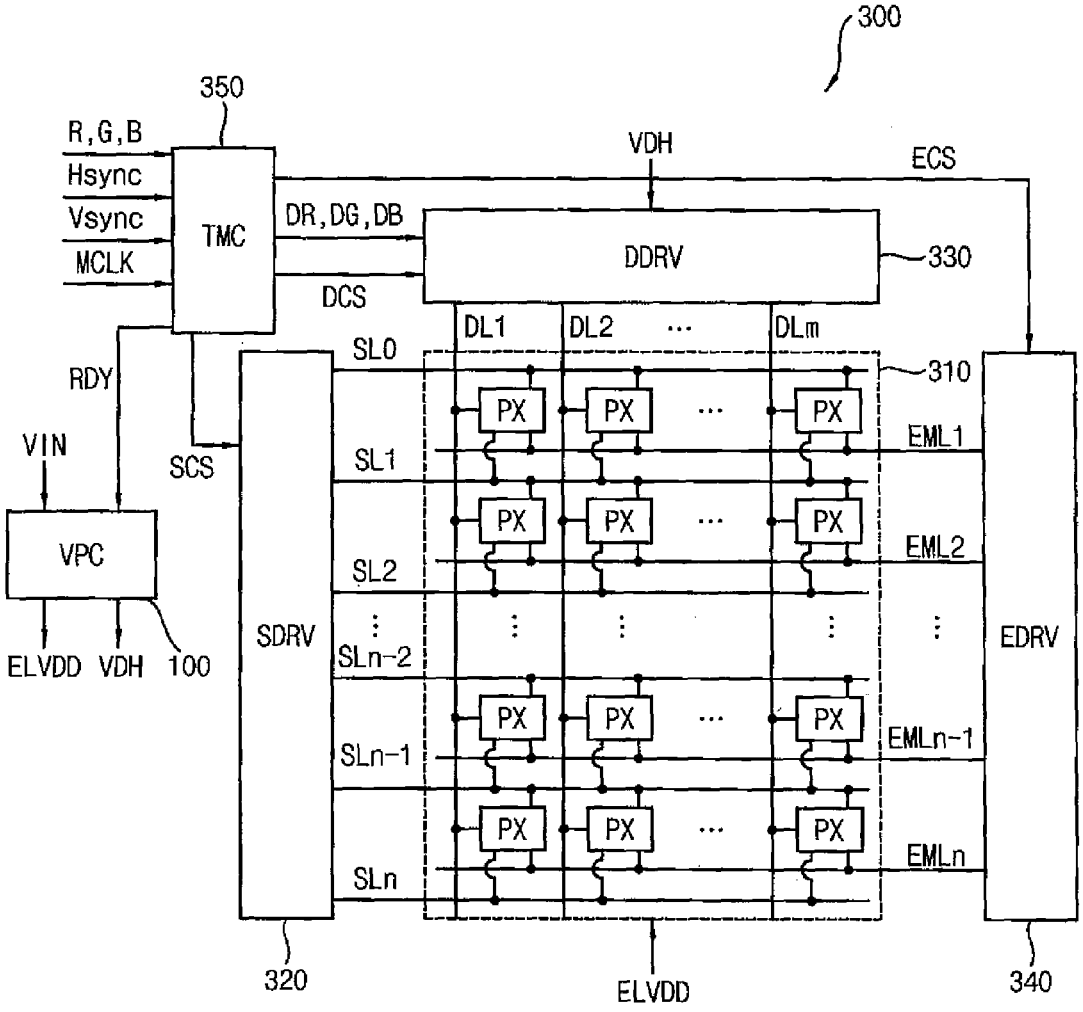
FIG. 4 is a block diagram illustrating a display device according to example embodiments.

FIG. 4 is a block diagram illustrating a display device according to example embodiments.

A display device 300 or display module illustrated in FIG. 4 may be an electroluminescent display device including a light-emitting diode (LED) or an organic light-emitting diode (OLED) that emits light through recombination of electrons and holes.

The display device 300 may include a display panel 310 including a plurality of pixels PX, a scan driver SDRV 320, a data driver DDRV 330, an emission control driver EDRV 340, a timing controller TMC 350 and a voltage providing circuit 100.

Figure 5:
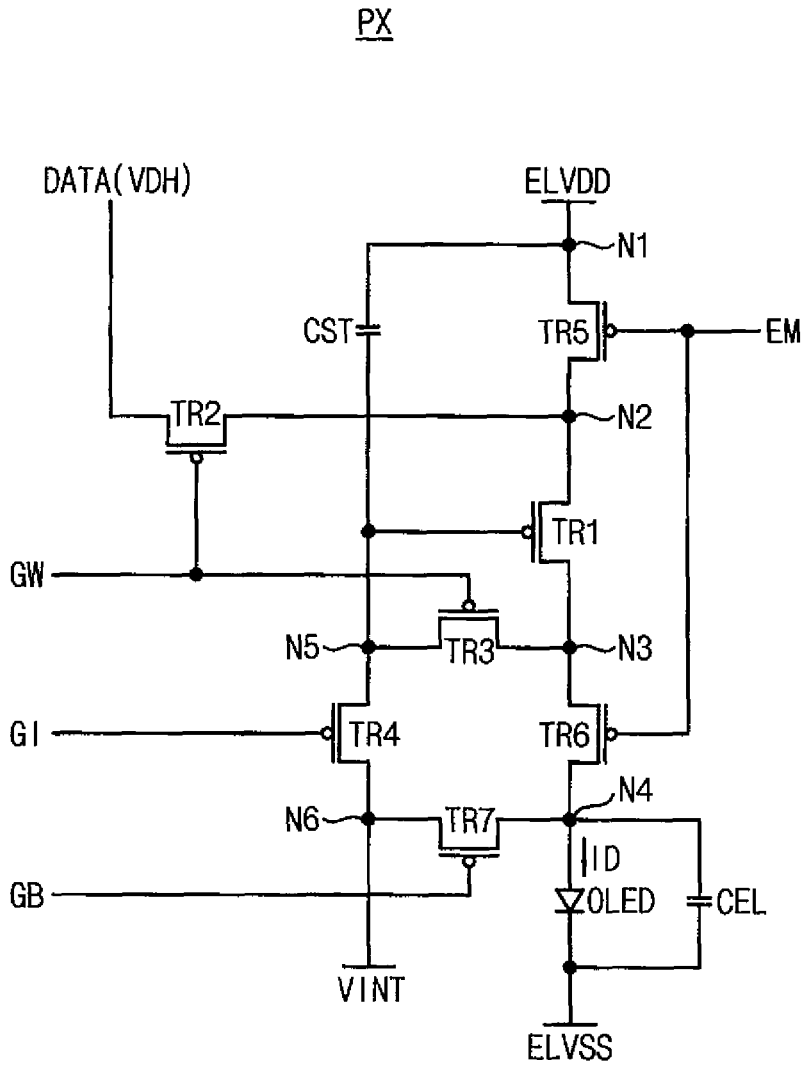
FIG. 5 is a circuit diagram illustrating an example of a pixel included in the display device of FIG. 4.

The scan driver 320 may provide row control signals GW, GI, and GB as illustrated in FIG. 5 to the pixels PX by units of rows through row control lines SL1~SLn. The data driver 330 may provide data signals DATA as illustrated in FIG. 5 to the pixels PX by units of columns through data lines DL1~DLm. The emission control driver 340 may provide emission control signals EM as illustrated in FIG. 5 to the pixels PX by units of rows through emission control lines EML1~EMLn.

The timing controller 350 may receive and convert image signals R, G, B from an external device and provide converted image data DR, DG, DB to the data driver 330. Also the timing controller 350 may receive a vertical synchronization signal Vsync, a horizontal synchronization signal Hsync, and a clock signal MCLK from the external device and generate control signals for the scan driver 320, the data driver 330, and the emission control driver 340. The timing controller 350 provides scan driving control signals SCS to the scan driver 320, data driving control signals DCS to the data driver 330, and emission driving control signals ECS to the emission control driver 340, respectively. Each pixel PX emits light by a driving current flowing through the LED or the OLED based on the data signals provided through the data lines DL1~DLm.

The data driver 330 generates the data signals based on the data voltage VDH. The display panel 310 receives the power supply voltage ELVDD and the pixels PX in the display panel 310 are driven based on the power supply voltage ELVSS and the data signals from the data driver 330. The timing controller 350 generates the ready signal indicating the power supply timing.

As described with reference to FIGS. 1, 2 and 3, the voltage providing circuit 200 includes a first voltage regulator, a second voltage regulator, and a power sequence controller. The first voltage regulator generates the power supply voltage ELVDD based on an input voltage VIN and a first enable signal. The second voltage regulator generates the data voltage VDH based on the input voltage VIN and a second enable signal. The power sequence controller generates the first enable signal based on the ready signal and the data voltage VDH and generates the second enable signal based on the ready signal and the power supply voltage ELVDD.

As such, the voltage providing circuit 100 and the display device 300 including the voltage providing circuit 100 according to example embodiments may have configuration such that the outputs of the voltage regulators are fed back to each other, and thus may control the power sequence efficiently without adding complex hardware and/or software.

FIG. 5 is a circuit diagram illustrating an example of a pixel included in the display device of FIG. 4. The digital driving method using the data voltage VDH and the power supply voltage ELVDD from the voltage providing circuit according to example embodiments is described with reference to FIG. 5. The configuration of FIG. 5 is a non-limiting example of the pixel and the configuration of the pixel may be changed variously.

Referring to FIG. 5, a pixel PX may include an OLED, a first transistor TR1, a second transistor TR2, a third transistor TR3, a storage capacitor CST, a fourth transistor TR4, a fifth transistor TR5, a sixth transistor TR6, and a seventh transistor TR7, which are connected through first through sixth nodes N1 through N6. In an example embodiment, the pixel. PX may further include a diode parallel capacitor CEL. In another example embodiment, the diode parallel capacitor CEL may be a capacitor formed by a parasitic capacitances.

The OLED may emit light based on a driving current ID. The anode of the OLED may be coupled to a negative power voltage ELVSS or a ground voltage and the cathode of the OLED may be coupled to the fourth node N4.

The first transistor TR1 may include a gate electrode connected to the fifth node N5, a source electrode coupled to the second node N2, and a drain electrode coupled to the third node N3. The first transistor TR1 may generate the driving current ID. The digital driving may be performed such that the grayscale is represented by the sum of the times in each frame during which the driving current ID is provided to the OLED.

The second transistor TR2 may include a gate electrode receiving a scan signal SW, a source electrode receiving the data signal DATA, and a drain electrode coupled to the second node N2. The second transistor TR2 may transfer the data signal DATA to the source electrode of the first transistor TR1 during the activation time interval of the scan signal SW.

The third transistor TR3 may include a gate electrode receiving the scan signal SW, a source electrode coupled to the fifth node N5, and a drain electrode coupled to the third node N3. The third transistor TR3 may electrically couple the gate electrode of the first transistor TR1 and the drain electrode of the first transistor TR1 during the activation time interval of the scan signal SW. In other words, the third transistor TR3 may form a diode-connection of the first transistor TR1 during the activation time interval of the scan signal SW. Through such diode-connection, the data signal DATA compensated with the respective threshold voltage of the first transistor TR1 may be provided to the gate electrode of the first transistor TR1. Such threshold voltage compensation may prevent or reduce irregularity of the driving current ID due to deviations of the threshold voltage of the first transistor TR1.

The storage capacitor CST may be coupled between the first node N1 and the fifth node N5. The storage capacitor CST maintains the voltage level on the gate electrode of the first transistor TR1 during the deactivation time interval of the scan signal SW. The deactivation time interval of the scan signal SW may include the activation time interval of an emission control signal EM. The driving current ID generated by the first transistor TR1 may be applied to the OLED during the activation time interval of the emission control signal EM.

The fourth transistor TR4 may include a gate electrode receiving a data initialization signal GI, a source electrode connected to the fifth node N5 and a drain electrode coupled to the sixth node N6. The fourth transistor TR4 may provide an initialization voltage VINT to the gate electrode of the first transistor TR1 during the activation time interval of the data initialization signal GI. In other words, the fourth transistor TR4 may initialize the gate electrode of the first transistor TR1 with the initialization voltage VINT during the activation time interval of the data initialization signal GI.

The fifth transistor TR5 may include a gate electrode receiving the emission control signal EM, a source electrode coupled to the first node N1, and a drain electrode coupled to the second node N2. The fifth transistor TR5 may provide the power supply voltage ELVDD to the second node N2 during the activation time interval of the emission control signal EM. In contrast, the fifth transistor TR5 may disconnect the second node N2 from the power supply voltage ELVDD during the deactivation time interval of the emission control signal EM. The first transistor TR1 may generate the driving current ID while the fifth transistor TR5 provides the power supply voltage ELVDD to the second node N2 during the activation time interval of the emission control signal EM. In addition, the data signal DATA compensated with the threshold voltage of the first transistor TR1 may be provided to the gate electrode of the first transistor TR1 while the fifth transistor TR5 disconnects the second node N2 from the power supply voltage ELVDD during the deactivation time interval of the emission control signal EM.

The sixth transistor TR6 may include a gate electrode receiving the emission control signal EM, a source electrode coupled to the third node N3, and a drain electrode coupled to the fourth node N4. The sixth transistor TR6 may provide the driving current ID generated by the first transistor TR1 to the OLED during the activation time interval of the emission control signal EM.

The seventh transistor TR7 may include a gate electrode receiving a diode initialization signal GB, a source electrode coupled to the sixth node N6, and a drain electrode coupled to the fourth node N4. The seventh transistor TR7 may provide the initialization voltage VINT to the anode of the OLED during the activation time interval of the diode initialization signal GB. In other words, the seventh transistor TR7 may initialize the anode of the OLED with the initialization voltage VINT during the activation time interval of the diode initialization signal GB.

In some example embodiments, the diode initialization signal GB may be the same as the data initialization signal GI. The initialization of the gate electrode of the first transistor TR1 and the initialization of the anode of the OLED may not affect each other, that is, independent of each other. Thus the diode initialization signal GB and the data initialization signal GI may combined as one signal. The initialization voltage VINT may depend on the characteristics of the diode parallel capacitor CEL and the initialization voltage VINT may be set to a sufficiently low voltage. In an example embodiment, the initialization voltage VINT may be set to the negative power supply voltage ELVSS or the ground voltage.

Figure 6:
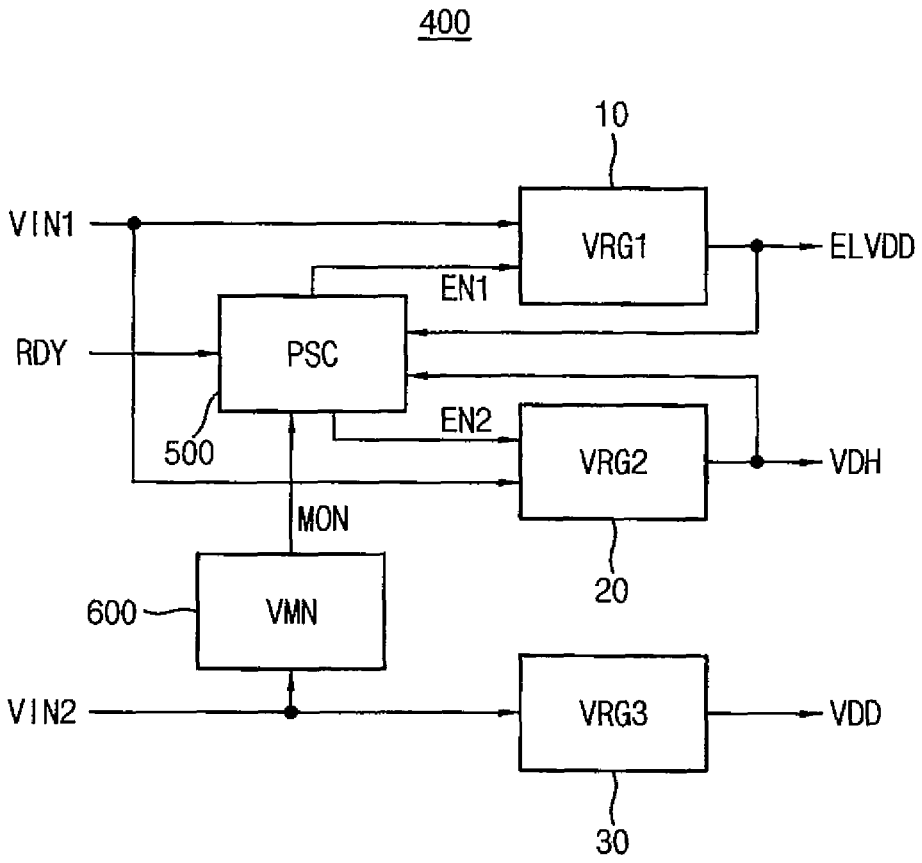
FIG. 6 is a block diagram illustrating a voltage providing circuit according to example embodiments.

FIG. 6 is a block diagram illustrating a voltage providing circuit according to example embodiments.

Referring to FIG. 6, a voltage providing circuit 400 includes a first voltage regulator VRG1 10, a second voltage regulator VRG2 20, a third voltage regulator VRG3 30, a power sequence controller PSC 500, and a voltage monitor 600

The first voltage regulator 10 generates a power supply voltage ELVDD based on a first input voltage VIN1 and a first enable signal EN1. The second voltage regulator 20 generates a data voltage VDH based on the first input voltage VIN1 and a second enable signal EN2. The third voltage regulator 30 generates a second power supply voltage VDD based on a second input voltage VIN2 lower than the first input voltage VIN1.

The first input voltage VIN1 and the second input voltage VIN2 may be provided from an external power source such as a switching mode power supply (SMPS). For example, the first input voltage VIN1 may be about 18V and the second input voltage VIN2 may be about 13V. The first power supply voltage ELVDD may be a power supply voltage of a display device including the voltage providing circuit 100, the data voltage VDH may be a voltage for driving a data signal in the display device, and the second power supply voltage VDD may be provided to logic circuits such as the timing controller of the display device. The first voltage regulator 10, the second voltage regulator 20, and the third voltage regulator 30 are designed to provide the stable voltages even though the voltage level and/or the frequency of the input voltage VIN are varied. The first voltage regulator 10, the second voltage regulator 20, and the third voltage regulator 30 may be referred to as a voltage converter, a power management integrated circuit (PMIC), etc.

The voltage monitor 600 is configured to monitor a change of the second input voltage VIN2 to generate a monitoring signal MON. The voltage monitor 600 is further described with reference to FIGS. 8 and 9.

The power sequence controller 500 is configured to receive the first power supply voltage ELVDD and the data voltage VDH that are fed-back from the first voltage regulator 10 and the second voltage regulator 20 to generate the first enable signal EN1 and the second enable signal EN2. As described with reference to FIG. 7, the power sequence controller 500 may generate the first enable signal EN1 based on the data voltage VDH, the monitoring signal MON and a ready signal RDY indicating a power supply timing and may generate the second enable signal EN2 based on the ready signal RDY and the first power supply voltage ELVDD.

Figure 7:
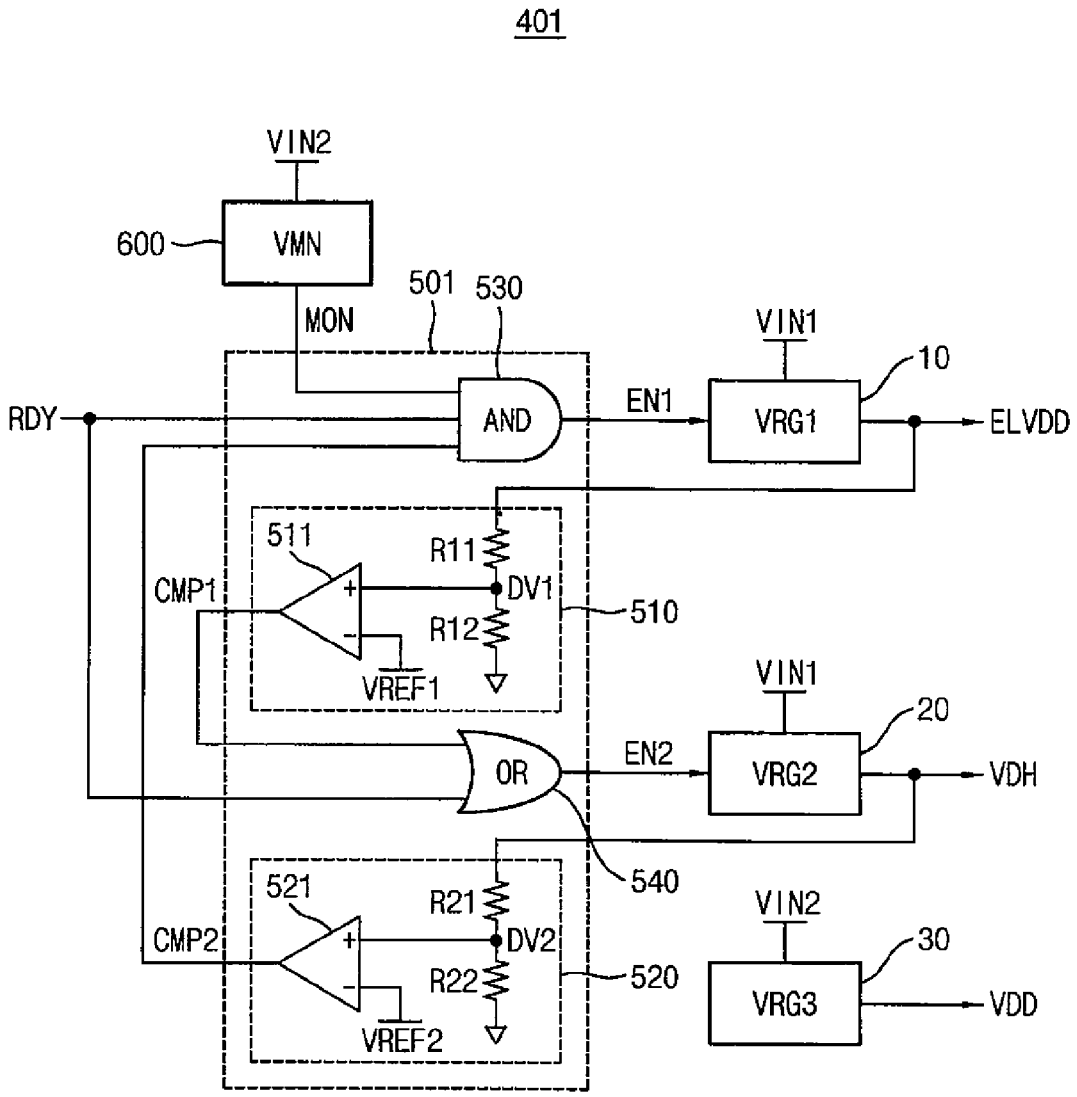
FIG. 7 is a circuit diagram illustrating a voltage providing circuit according to an example embodiment.

FIG. 7 is a circuit diagram illustrating a voltage providing circuit according to an example embodiment.

Referring to FIG. 7, a voltage providing circuit 401 includes a first voltage regulator VRG1 10, a second voltage regulator VRG2 20, a third voltage regulator VRG 30, a power sequence controller 501, and a voltage monitor VMN 600.

The first voltage regulator 10 generates a first power supply voltage ELVDD based on a first input voltage VIN1 and a first enable signal EN1. The second voltage regulator 20 generates a data voltage VDH based on the first input voltage VIN1 and a second enable signal EN2. The third voltage regulator 30 generates a second power supply voltage VDD based on a second input voltage VIN2 lower than the first input voltage VIN1. The voltage monitor 600 monitors a change of the second input voltage VIN2 to generate a monitoring signal MON. The voltage monitor 600 is further described with reference to FIGS. 8 and 9.

The power sequence controller 501 may include a first feedback unit 510, a second feedback unit 520, an AND logic gate 530 and an OR logic gate 540.

The first feedback unit 510 may compare the first power supply voltage ELVDD and a first voltage level VL1 to generate a first comparison signal CMP1 that is activated when the first power supply voltage ELVDD is higher than the first voltage level VL1. The first voltage level is the same as described with reference to FIG. 3. The second feedback unit 520 may compare the data voltage VDH and a second voltage level VL2 to generate a second comparison signal CMP2 that is activated when the data voltage VDH is higher than the second voltage level VL2. The second voltage level VL2 is the same as described with reference to FIG. 3. The AND logic gate 530 may perform an AND logic operation on the monitoring signal MON, the ready signal RDY, and the second comparison signal CMP2 to generate the first enable signal EN1. The OR logic gate 540 may perform an OR logic operation on the ready signal RDY and the first comparison signal CMP1 to generate the second enable signal EN2.

The power sequence controller 501 may control the activation and deactivation timings of the first enable signal EN1 using the AND logic gate 530 and performing an AND logic operation on the monitoring signal MON, the ready signal RDY and the second comparison signal CMP2 that is based on the fed-back data voltage VDH. In other words, the power sequence controller 501 may activate the first enable signal EN1 when the monitoring signal MON is activated, the data voltage increases higher than the second voltage level VL2 and the ready signal RDY is activated. In addition, the power sequence controller 501 may deactivate the first enable signal EN1 when the monitoring signal MON is deactivated, the data voltage VDH decreases lower than the second voltage level VL2 or the ready signal RDY is deactivated.

The power sequence controller 501 may control the activation and deactivation timings of the second enable signal EN2 using the OR logic gate 540 and performing an OR logic operation on the ready signal RDY and the first comparison signal CMP1 that is based on the fed-back first power supply voltage ELVDD. In other words, the power sequence controller 501 may activate the second enable signal EN when the first power supply voltage ELVDD increases higher than the first voltage level VL1 or the ready signal RDY is activated. In addition, the power sequence controller 501 may deactivate the second enable signal EN2 when the first power supply voltage ELVDD decreases lower than the first voltage level VL1 and the ready signal RDY is deactivated.

As such, the power sequence controller 201 may implement the power-on sequence at time points t1 and t2 and the power-off sequence at time points t3 and t4 as illustrated in FIG. 2 using the AND logic gate 530 and the OR logic gate 540. Further the voltage providing circuit 501 may control the power sequence efficiently in unexpected power-off situations using the voltage monitor 600 and thus may enhance image quality by preventing or reducing flickering of displayed images.

The first feedback unit 510 and the second feedback unit 520 in FIG. 7 are substantially the same as those of FIG. 3, and the repeated descriptions are omitted.

Figure 8:
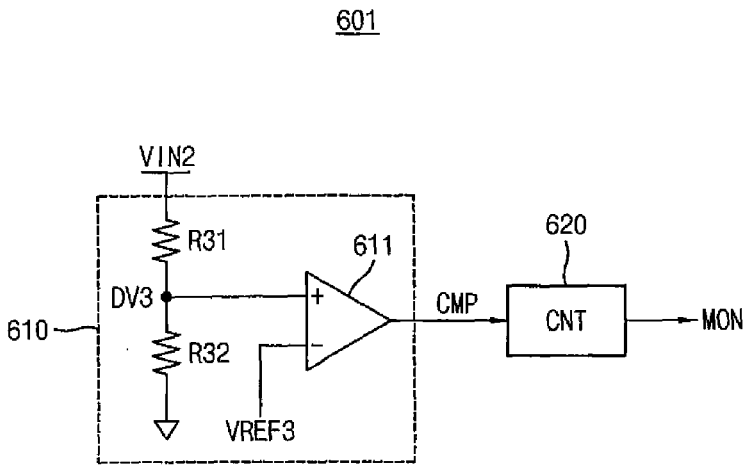
FIG. 8 is a diagram illustrating an example embodiment of a voltage monitor included in the voltage providing circuit of FIG. 7.
Figure 9:
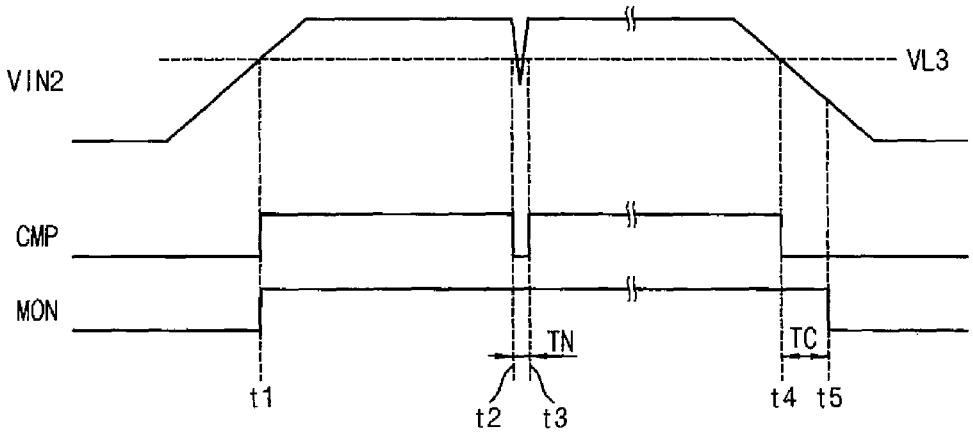
FIG. 9 is a timing diagram illustrating an operation of the voltage monitor of FIG. 8.

FIG. 8 is a diagram illustrating an example embodiment of a voltage monitor included in the voltage providing circuit of FIG. 7, and FIG. 9 is a timing diagram illustrating an operation of the voltage monitor of FIG. 8.

Referring to FIG. 8, a voltage monitor 601 may include a detector 610 and a counting unit CNT 620.

The detector 610 may compare the second input voltage VIN2 and a reference voltage level VL3 to generate a comparison signal CMP that is activated when the second input voltage VIN2 is higher than the reference voltage level VL3. As illustrated in FIG. 8, the detector 610 may include division resistors R31 and R32 and a comparator 611. The division resistors R31 and R32 may divide the second input voltage VIN2 to provide a division voltage DV3, and the comparator 611 may compare the division voltage DV3 and a reference voltage VREF3 to generate the comparison signal CMP. The detector 610 may compare the second input voltage VIN2 and the reference voltage level VL3 by comparing the division voltage DV3 and the reference voltage VREF3. The reference voltage level VL3 may be obtained using the relation VL3=VREF3*(R31+FR32)/R32. Accordingly the reference time interval TC in FIG. 9 may be adjusted by controlling the resistance ratio of the division resistors R31 and R32.

The counting unit 620 may generate the monitoring signal MON based on transition timings of the comparison signal CMP such that the counting unit 620 activates the monitoring signal MON when the second input voltage VIN2 increases higher than the reference voltage level VL3 and deactivates the monitoring signal MON when the second input voltage VIN2 maintains lower than the reference voltage level VL3 for the reference time interval TC. For example, the counting unit 620 may use a counter configured to count the reference time interval TC from a falling edge of the comparison signal CMP.

Referring to FIGS. 8 and 9, the voltage monitor 601 may activate the monitoring signal MON at time point t1 when the second input voltage VIN2 increases higher than the reference voltage level VL3. As such, the voltage monitor 601 may bypass, without delay, the rising edge of the comparison signal CMP as the rising edge of the monitoring signal MON.

In contrast, the voltage monitor 601 may deactivate the monitoring signal MON when the second input voltage VIN2 maintains lower than the reference voltage level VL3 for the reference time interval TC. As such, the voltage monitor 601 may delay the falling edge of the comparison signal CMP and transferred the delayed falling edge as the falling edge of the monitoring signal MON.

Accordingly the monitoring signal MON may not be deactivated even though the comparison signal CMP is deactivated temporarily due to noises during time interval t2~t2 or a noise time interval TN. In contrast, the monitoring signal MON may be deactivated when the comparison signal CMP maintains the deactivated state for the reference time interval, that is, during time interval t4~t5. The OR logic gate 530 in FIG. 7 may deactivate the first enable signal EN1 in response to the deactivated monitoring signal MON regardless of the ready signal RDY and the second comparison signal CMP2. Accordingly the power sequence may be controlled efficiently in unexpected power-off situations using the voltage monitor 601 and thus image quality may be enhanced by preventing or reducing flickering of displayed images.

Figure 10:
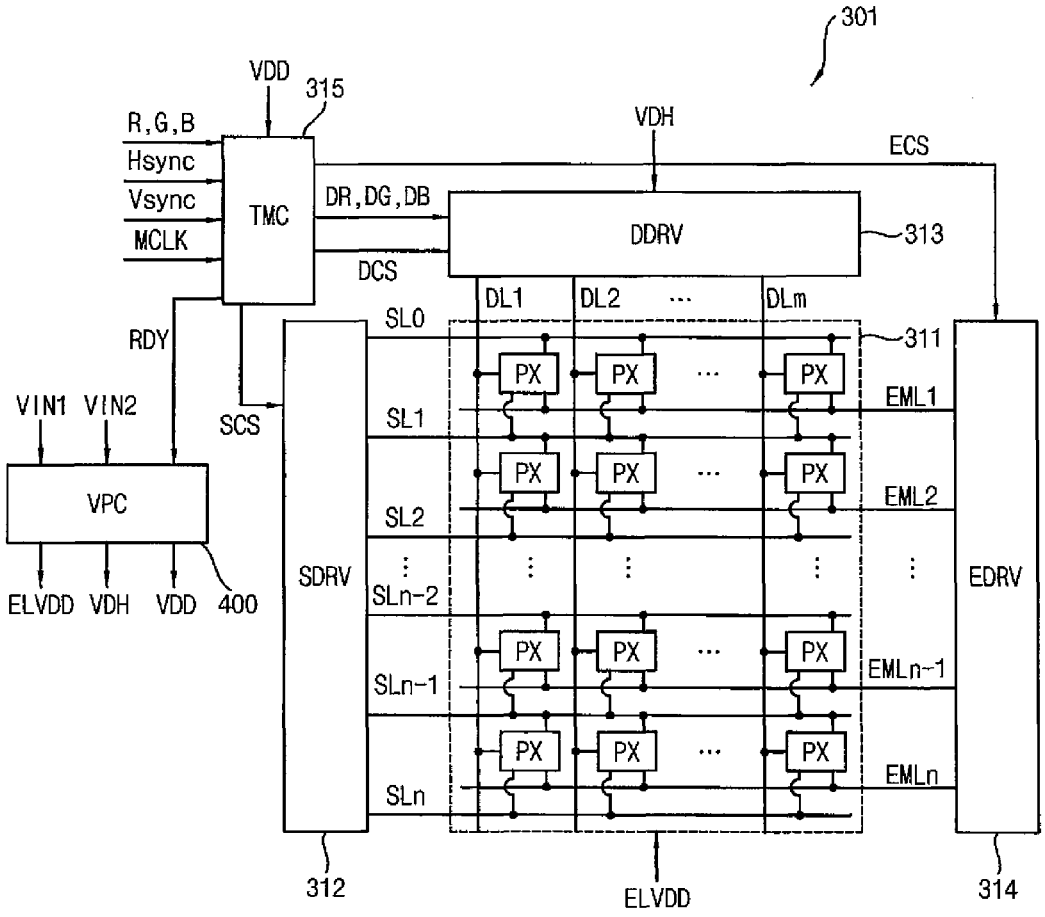
FIG. 10 is a block diagram illustrating a display device according to example embodiments.

FIG. 10 is a block diagram illustrating a display device according to example embodiments.

A display device 301 or display module illustrated in FIG. 10 may be an electroluminescent display device including a light-emitting diode (LED) or an organic light-emitting diode (OLED) that emits light through recombination of electrons and holes.

The display device 301 may include a display panel 311 including a plurality of pixels PX, a scan driver SDRV 312, a data driver DDRV 313, an emission control driver EDRV 314, a timing controller TMC 315, and a voltage providing circuit 400.

The scan driver 312 may provide row control signals GW, GI, and GB as illustrated in FIG. 5 to the pixels PX by units of rows through row control lines SL1~SLn. The data driver 313 may provide data signals DATA as illustrated in FIG. 5 to the pixels PX by units of columns through data lines DL1~DLm. The emission control driver 314 may provide emission control signals EM as illustrated in FIG. 5 to the pixels PX by units of rows through emission control lines EML1~EMLn.

The timing controller 315 may receive and convert image signals R, G, B from an external device and provide converted image data DR, DG, DB to the data driver 313. Also the timing controller 315 may receive a vertical synchronization signal Vsync, a horizontal synchronization signal Hsync and a clock signal MCLK from the external device and generate control signals for the scan driver 312, the data driver 313 and the emission control driver 314. The timing controller 315 provides scan driving control signals SCS to the scan driver 312, data driving control signals DCS to the data driver 313, and emission driving control signals ECS to the emission control driver 314, respectively. Each pixel PX emits light by a driving current flowing through the LED or the OLED based on the data signals provided through the data lines DL1~DLm.

The data driver 313 generates the data signals based on the data voltage VDH. The display panel 311 receives the first power supply voltage ELVDD and the pixels PX in the display panel 311 are driven based on the power supply voltage ELVSS and the data signals from the data driver 330. The timing controller 315 receives the second power supply voltage VDD and generates the ready signal indicating the power supply timing.

As described with reference to FIGS. 6, 7, 8, and 9, the voltage providing circuit 400 includes a first voltage regulator, a second voltage regulator, a third voltage regulator, a power sequence controller, and a voltage monitor. The first voltage regulator generates the first power supply voltage ELVDD based on a first input voltage VIN1 and a first enable signal. The second voltage regulator generates the data voltage VDH based on the first input voltage VIN1 and a second enable signal. The third voltage regulator generates the second power supply voltage VDD based on a second input voltage VIN2 lower than the first input voltage VIN1. The voltage monitor monitors a change of the second input voltage VIN2 to generate a monitoring signal. The power sequence controller generates the first enable signal based on the monitoring signal, the ready signal and the data voltage VDH and generates the second enable signal based on the ready signal RDY and the power supply voltage ELVDD.

As such, the voltage providing circuit 400 and the display device 301 including the voltage providing circuit 400 according to example embodiments may have configuration such that the outputs of the voltage regulators are feedback to each other, and thus may control the power sequence efficiently without adding complex hard ware and/or software. Further the voltage providing circuit 400 and the display device 301 including the voltage providing circuit 400 may control the power sequence efficiently in unexpected power-off situations using the voltage monitor and thus may enhance image quality by preventing or reducing flickering of displayed images.

Figure 11:
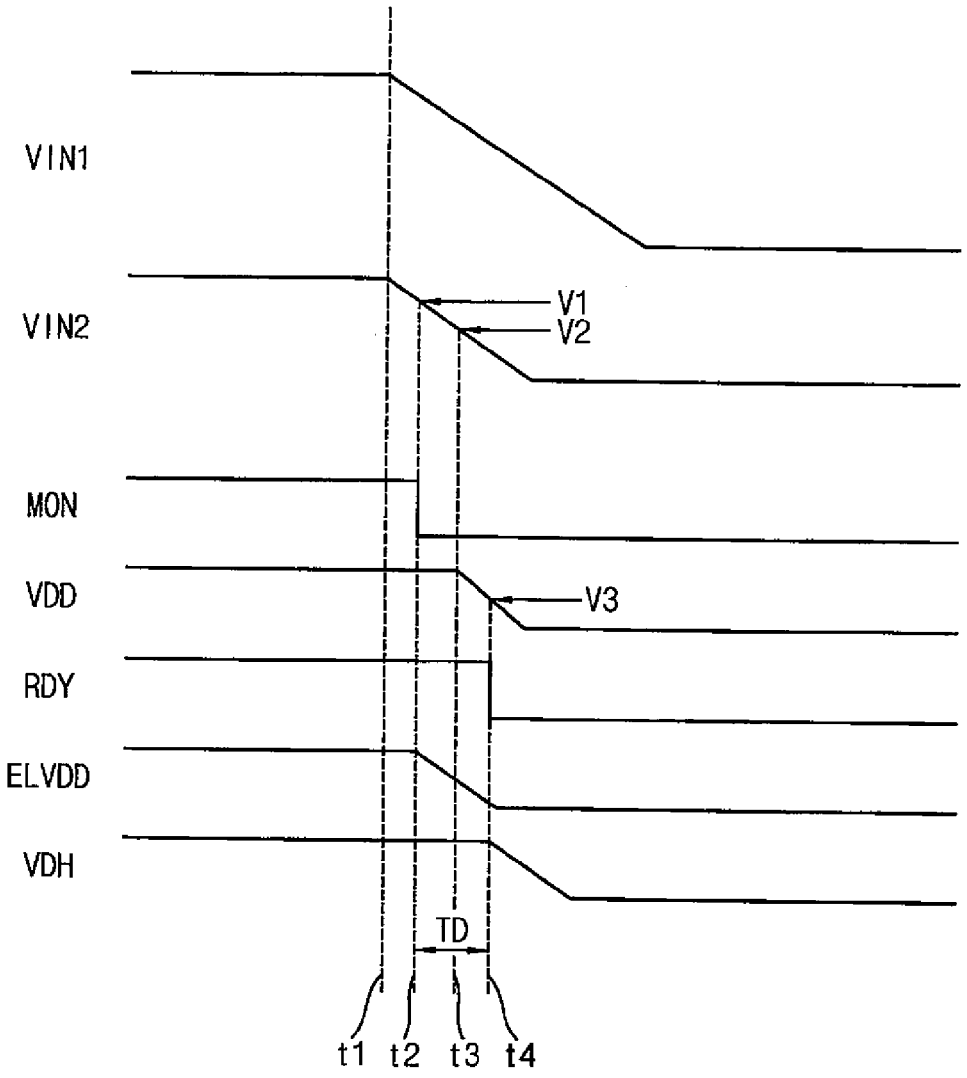
FIG. 11 is a timing diagram illustrating a power-off sequence of the display device of FIG. 10.

FIG. 11 is a timing diagram illustrating a power-off sequence of the display device of FIG. 10.

Referring to FIGS. 7 through 11, a power-off sequence of the display device 301 begins at time point t1 when the first input voltage VIN1 and the second input voltage VIN2 from the external source decrease.

At time point t2, when the second input voltage VIN2 decreases and reaches a voltage level V1, the voltage monitor 600 in FIG. 7 deactivates the monitoring signal MON. As described with reference to FIGS. 8 and 9, the deactivation timing t2 may be delayed by the reference time interval TC after the deactivation timing of the comparison signal CMP.

When the monitoring signal MON is deactivated at time point t2, the AND logic gate 530 in FIG. 7 deactivates the first enable signal EN1 regardless of the ready signal RDY and the second comparison signal CMP2. The first voltage regulator 10 is disabled and the first power supply voltage ELVDD begins to decrease in response to the deactivated first enable signal EN1.

At time point t3, when the second input voltage V1 N2 decreases and reaches a voltage level V2, the third voltage regulator 30 in FIG. 7 is disabled and the second power supply voltage VDD begins to decrease.

At time point t4, when the second power supply voltage VDD decreased and reaches a voltage level V3, the timing controller 315 in FIG. 10 deactivates the ready signal RDY.

When the ready signal RDY is deactivated at time point t4, the OR logic gate in FIG. 7 deactivates the second enable signal EN2. The second voltage regulator 20 is disabled and the data voltage VDH begins to decrease in response to the deactivated second enable signal EN2.

As a result, the second voltage regulator 20 may be disabled and the power-off of the data voltage VDH may begin at time t4 after the delay time TD from time point t2 when the first voltage regulator 10 is disabled and the power-off of the first power supply voltage ELVDD begins. As such, the first power supply voltage ELVDD provided to the display panel 311 may be off firstly and then the data voltage VDH for driving the data signal may be off, thereby preventing or reducing flickering of the displayed images during the power-off sequence.

Figure 12:
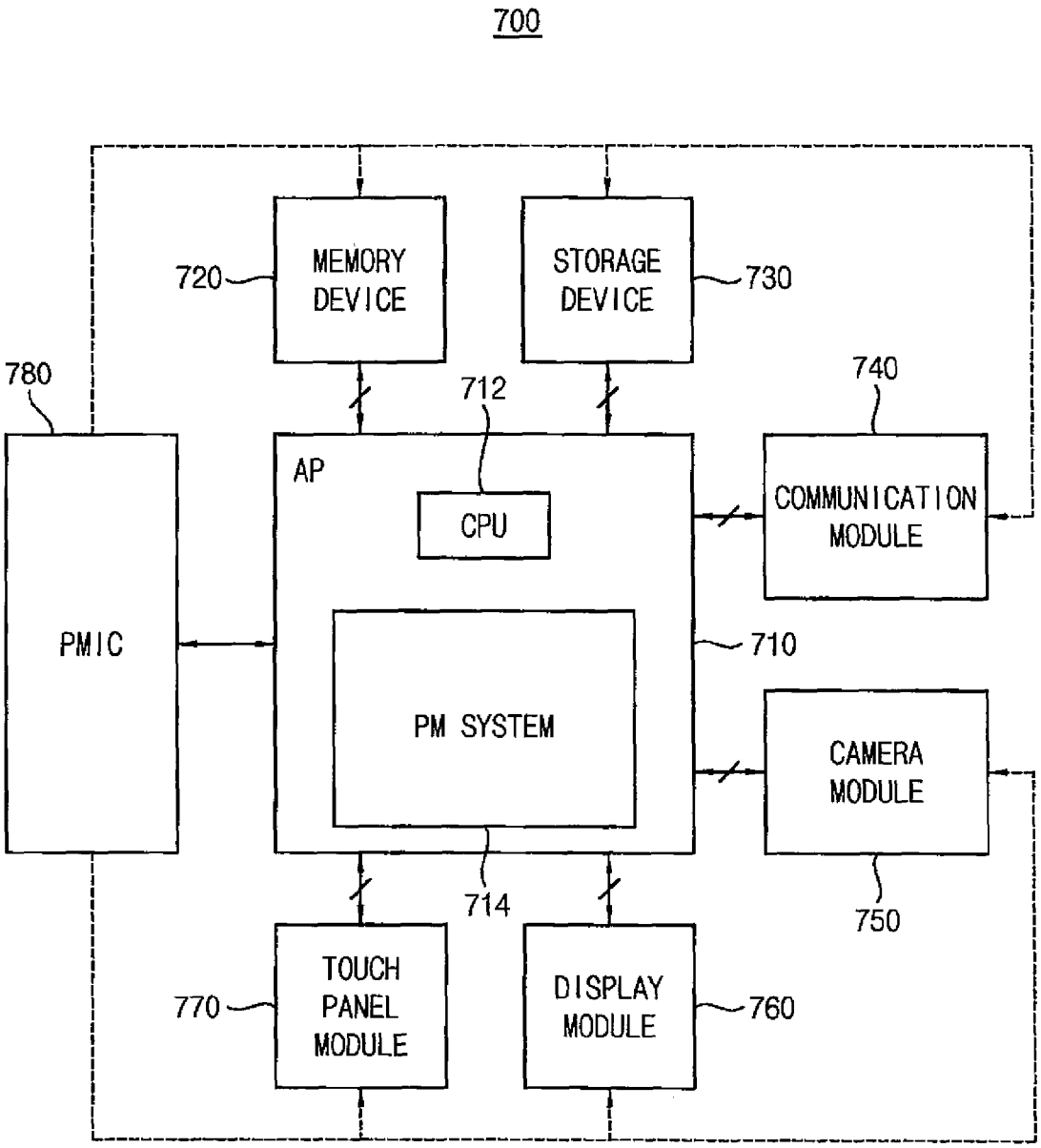
FIG. 12 is a block diagram illustrating a mobile device according to example embodiments.

FIG. 12 is a block diagram illustrating a mobile device according to example embodiments.

Referring to FIG. 12, a mobile device 700 includes a system on chip 710 and a plurality of functional modules 740, 750, 760, and 770. The mobile device 700 may further include a memory device 720, a storage device 730, and a power management integrated circuit (PMIC) 780.

The system on chip 710 controls overall operations of the mobile device 700. The system on chip 710 may control the memory device 720, the storage device 730, and the functional modules 740, 750, 760, and 770. For example, the system on chip 710 may be an application processor (AP). The system on chip 710 may include a CPU core 711 and a power management (PM) system 714.

The memory device 720 and the storage device 730 may store data for operations of the mobile device 700. The memory device 720 may correspond to a volatile semiconductor memory device such as a dynamic random access memory (DRAM) device, a static random access memory (SRAM) device, a mobile DRAM, etc. In addition, the storage device 730 may correspond to a non-volatile semiconductor memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc. In some embodiments, the storage device 730 may correspond to a solid state drive (SSD) device, a hard disk drive (HDD) device, a CD-ROM device, etc.

The functional modules 740, 750, 760, and 770 perform various functions of the mobile device 700. For example, the mobile device 700 may comprise a communication module 740 that performs a communication function (e.g., a code division multiple access (CDMA) module, a long term evolution (LTE) module, a radio frequency (RF) module, an ultra wideband (UWB) module, a wireless local area network (WLAN) module, a worldwide interoperability for a microwave access (WIMAX) module, etc.), a camera module 750 that performs a camera function, a display module 760 that performs a display function, a touch panel module 770 that performs a touch sensing function, etc. In some embodiments, the mobile device 700 further includes a global positioning system (GPS) module, a microphone (MIC) module, a speaker module, a gyroscope module, etc. However, a category of the functional modules 740, 750, 760, and 770 in the mobile device 700 is not limited thereto.

The PMIC 780 may provide driving voltages to the system on chip 710, the memory device 720 and the functional modules 740, 750, 760, and 770, respectively.

According to example embodiments, the display module 760 includes a voltage providing circuit. As described above, the voltage providing circuit includes a first voltage regulator, a second voltage regulator, and a power sequence controller. The first voltage regulator generates a power supply voltage based on an input voltage and a first enable signal. The second voltage regulator generates a data voltage based on the input voltage and a second enable signal. The power sequence controller generates the first enable signal based on a ready signal and the data voltage and generates the second enable signal based on the ready signal and the power supply voltage.

Figure 13:
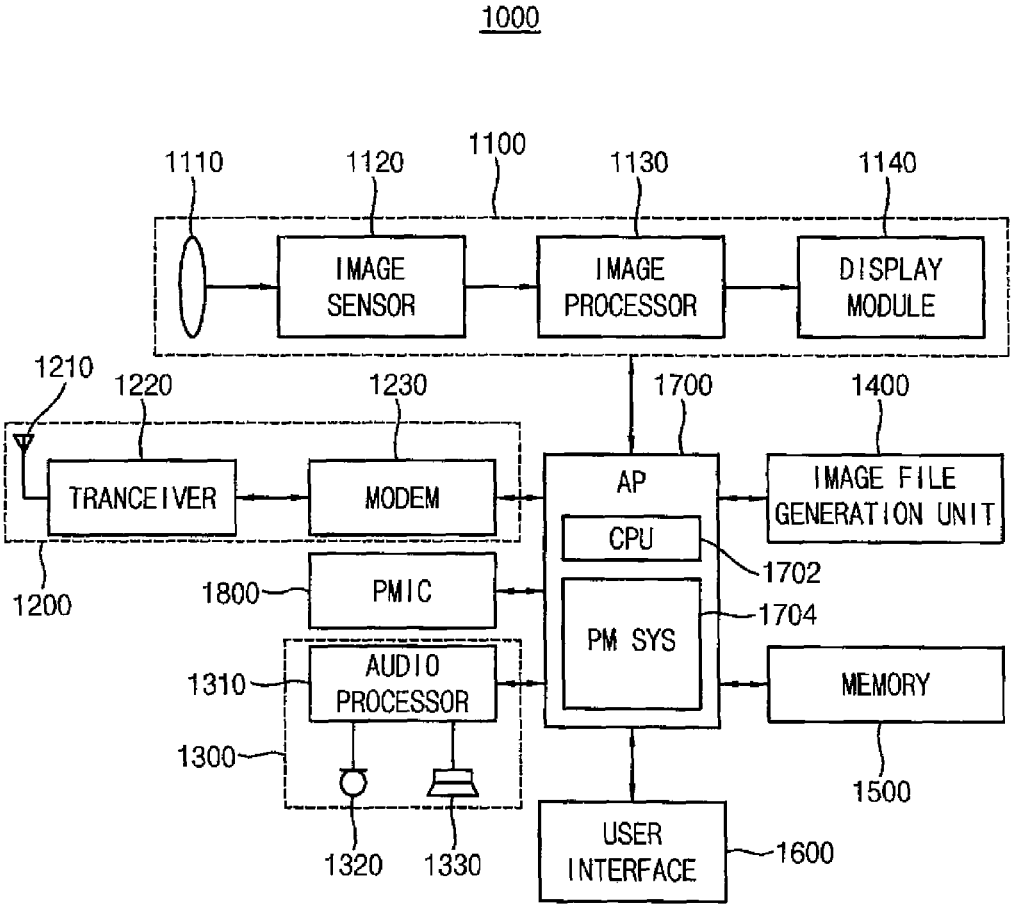
FIG. 13 is a block diagram illustrating a portable terminal according to example embodiments.

FIG. 13 is a block diagram illustrating a portable terminal according to example embodiments.

Referring to FIG. 13, a portable terminal 1000 includes an image processing block 1100, a wireless transceiving block 1200, an audio processing block 1300, an image file generation unit 1400, a memory device 1500, a user interface 1600, an application processor 1700, and a power management integrated circuit (PMIC) 1800.

The image processing block 1100 includes a lens 1110, an image sensor 1120, an image processor 1130, and a display module 1140. The wireless transceiving block 1200 includes an antenna 1210, a transceiver 1220, and a modem 1230. The audio processing block 1300 includes an audio processor 1310, a microphone 1320, and a speaker 1330.

According to example embodiments, the display module 1140 includes a voltage providing circuit. As described above, the voltage providing circuit includes a first voltage regulator, a second voltage regulator, and a power sequence controller. The first voltage regulator generates a power supply voltage based on an input voltage and a first enable signal. The second voltage regulator generates a data voltage based on the input voltage and a second enable signal. The power sequence controller generates the first enable signal based on a ready signal and the data voltage and generates the second enable signal based on the ready signal and the power supply voltage.

The portable terminal 1000 may include various kinds of semiconductor devices. The application processor 1700 requires low power consumption and a high performance. The application processor 1700 may have multi-cores as a manufacturing process has become minutely detailed. The application processor 1700 may include a CPU core 1702 and a power management (PM) system 1704.

The PMIC 1800 may provide driving voltages to the image processing block 1100, the wireless transceiving block 1200, the audio processing block 1300, the image file generation unit 1400, the memory device 1500, the user interface 1600, and the application processor 1700, respectively.

The above described embodiments may be applied to various categories of devices and systems such as a mobile phone, a smart phone, a tablet computer, a laptop computer, a personal digital assistant PDA, a portable multimedia player PMP, a digital television, a digital camera, a portable game console, a music player, a camcorder, a video player, a navigation system, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims, and their equivalents.

What is claimed is:

1. A display device comprising:

a data driver configured to generate a data signal based on a data voltage;

a display panel configured to be driven based on a first power supply voltage and the data signal;

a timing controller configured to control operations of the data driver and the display panel and configured to generate a ready signal indicating a power supply timing;

a first voltage regulator configured to generate the first power supply voltage based on a first input voltage and a first enable signal;

a second voltage regulator configured to generate the data voltage based on the first input voltage and a second enable signal; and a power sequence controller configured to activate the first enable signal based on the ready signal and the data voltage after activating the second enable signal based on the ready signal and the first power supply voltage, wherein the power sequence controller comprises:

a first feedback circuit configured to compare the first power supply voltage and a first voltage level to generate a first comparison signal that activated when the first power supply voltage is higher than the first voltage level;

a second feedback circuit configured to compare the data voltage and a second voltage level to generate a second comparison signal that is activated when the data voltage is higher than the second voltage level;

an AND logic gate configured to perform an AND logic operation on the ready signal and the second comparison signal to generate the first enable signal; and an OR logic gate configured to perform an OR logic operation on the ready signal and the first comparison signal to generate the second enable signal.

2. The display device of claim 1, wherein the power sequence controller is configured to deactivate the second enable signal after deactivating the first enable signal, and wherein the second voltage regulator is configured to be disabled in response to the second enable signal after the first voltage regulator is disabled in response to the first enable signal.

3. The display device of claim 1, wherein the power sequence controller is configured to activate the first enable signal after activating the second enable signal, and wherein the first voltage regulator is configured to be enabled in response to the first enable signal after the second voltage regulator is enabled in response to the second enable signal.

4. The display device of claim 1, wherein the power sequence controller is configured to activate the second enable signal when the first power supply voltage higher than the first voltage level or the ready signal is activated.

5. The display device of claim 1, wherein the power sequence controller is configured to deactivate the second enable signal when the first power supply voltage decreases lower than the first voltage level and the ready signal is deactivated.

6. The display device of claim 1, wherein the power sequence controller is configured to activate the first enable signal when the data voltage increases higher than the second voltage level and the ready signal is activated.

7. The display device of claim 1, wherein the power sequence controller is configured to deactivate the first enable signal when the data voltage decreases lower than the second voltage level or the ready signal is deactivated.

8. The display device of claim 1 wherein the first feedback circuit comprises: first division resistors configured to divide the first power supply voltage to provide a first division voltage; and a first comparator configured to compare the first division voltage and a first reference voltage to generate the first comparison signal.

9. The display device of claim 1 wherein the second feedback circuit comprises: second division resistors configured to divide the data voltage to provide a second division voltage; and a second comparator configured to compare the second division voltage and a second reference voltage to generate the second comparison signal.

10. The display device of claim 1, further comprising:

a voltage monitor configured to monitor a change of a second input voltage to generate a monitoring signal.

11. The display device of claim 10, further comprising:

a third voltage configured to generate a second power supply voltage based on the second input voltage, wherein the second power supply voltage is provided to the timing controller as a power source.

12. The display device of claim 10, wherein the power sequence controller is configured to generate the first enable signal based on the ready signal, the data voltage, and the monitoring signal.

13. The display device of claim 10, wherein the voltage monitor is configured to activate the monitoring signal when the second input voltage increases higher than a reference voltage level.

14. The display device of claim 13, wherein the voltage monitor is configured to deactivate the monitoring signal when the second input voltage is maintained lower than the reference voltage level for a reference time interval.

15. The display device of claim 10, wherein the voltage monitor comprises:

a detector configured to compare the second input voltage and a reference voltage level to generate a comparison signal that is activated when the second input voltage is higher than the reference voltage level; and a counting circuit configured to generate the monitoring signal based on transition timings of the comparison signal such that the counting circuit is configured to activate the monitoring signal when the second input voltage increases higher than a reference voltage level and to deactivate the monitoring signal when the second input voltage is maintained lower than the reference voltage level for a reference time interval.

16. A voltage providing circuit comprising:

a first voltage regulator configured to generate a power supply voltage based on an input voltage and a first enable signal;

a second voltage regulator configured to generate a data voltage based on the input voltage and a second enable signal; and a power sequence controller configured to activate the first enable signal based on the data voltage and a ready signal indicating a power supply timing after activating the second enable signal based on the ready signal and the power supply voltage, wherein the power sequence controller comprises:

a first feedback circuit configured to compare the power supply voltage and a first voltage level to generate a first comparison signal that is activated when the power supply voltage is higher than the first voltage level;

a second feedback circuit configured to compare the data voltage and a second voltage level to generate a second comparison signal that is activated when the data voltage is higher than the second voltage level;

an AND logic gate configured to perform an AND logic operation on the ready signal and the second comparison signal to generate the first enable signal; and an OR logic gate configured to perform an OR logic operation on the ready signal and the first comparison signal to generate the second enable signal.

* * * * *